US011274451B2

(12) United States Patent
Bergman

(10) Patent No.: US 11,274,451 B2
(45) Date of Patent: Mar. 15, 2022

(54) BALUSTER CONNECTOR APPARATUS AND METHOD

(71) Applicant: Richard Bergman, Ottawa (CA)

(72) Inventor: Richard Bergman, Ottawa (CA)

( * ) Notice: Subject to any disclaimer, the term of this patent is extended or adjusted under 35 U.S.C. 154(b) by 815 days.

(21) Appl. No.: 15/954,106

(22) Filed: Apr. 16, 2018

(65) Prior Publication Data

US 2018/0305936 A1 Oct. 25, 2018

Related U.S. Application Data

(60) Provisional application No. 62/485,626, filed on Apr. 14, 2017.

(51) Int. Cl.
*E04F 11/18* (2006.01)

(52) U.S. Cl.
CPC ..... *E04F 11/1846* (2013.01); *E04F 11/1814* (2013.01); *E04F 11/1817* (2013.01); *E04F 2011/1819* (2013.01); *E04F 2011/1821* (2013.01); *E04F 2011/1823* (2013.01)

(58) Field of Classification Search
CPC ..... E04F 11/1814; E04F 11/1817; E04F 11/1819; E04F 11/1821; E04F 11/1823; E04F 11/1825; E04F 11/1827; E04F 11/1846; E04F 11/1812; E04F 2011/1819; E04F 2011/1821; E04F 2011/1823; E04F 2011/1825; E04F 2011/1827
See application file for complete search history.

(56) References Cited

U.S. PATENT DOCUMENTS

| | | | | |
|---|---|---|---|---|
| 1,772,159 | A | 4/1927 | Roth | |
| 6,126,145 | A | 10/2000 | Mohr | |
| 7,044,448 | B1 | 5/2006 | Jones | |
| 7,441,750 | B1 | 10/2008 | Harder | |
| 7,971,412 | B1 | 7/2011 | Lim | |
| 8,356,803 | B2 | 1/2013 | Truckner | |
| 8,424,850 | B2 * | 4/2013 | Bennette | E04H 17/1447 256/65.05 |
| 8,936,233 | B1 | 1/2015 | Sneith | |
| 9,169,651 | B1 * | 10/2015 | Wynne | E04F 11/1812 |
| 9,874,024 | B2 * | 1/2018 | Green | E04F 11/1812 |
| 9,896,864 | B2 * | 2/2018 | Zhu | E04H 17/22 |
| 2007/0102690 | A1 * | 5/2007 | Kastropil | E04F 11/1812 256/65.01 |
| 2011/0253964 | A1 | 10/2011 | Bennette | |
| 2013/0128591 | A1 * | 5/2013 | Bennette | F21V 33/006 362/311.02 |

(Continued)

*Primary Examiner* — Matthew R McMahon

(57) ABSTRACT

A removably locking baluster system in a balustrade in which a pair of connector bases mount to facing balustrade surfaces. Each base has a wall extending therefrom defining an inner wall surface and an inwardly tapered outer wall surface. An end of the baluster closely and removably fits within the base wall without necessitating removal of the bases from the balustrade. A pair of covers are provided that are slidable along the baluster, each having a tubular member with an opening configured to fit around the baluster and another opening configured to closely fit around the base. An internal wall of each cover is configured to closely abut the outer base wall surface and has a complementary taper to the outer base wall surface to urge the base wall against the baluster end to provide frictional engagement between the inner base wall surface and the baluster.

10 Claims, 6 Drawing Sheets

(56) References Cited

U.S. PATENT DOCUMENTS

| | | | | |
|---|---|---|---|---|
| 2013/0214228 | A1* | 8/2013 | Sneith | E04F 11/1812 256/65.07 |
| 2014/0217347 | A1* | 8/2014 | Green | E04F 11/1814 256/66 |
| 2015/0211235 | A1* | 7/2015 | Sneith | E04F 11/1812 248/219.1 |
| 2020/0165825 | A1* | 5/2020 | Price | E04F 11/1817 |
| 2020/0284041 | A1* | 9/2020 | Legault | E04F 11/1817 |

* cited by examiner

BALUSTER CONNECTOR APPARATUS AND METHOD

FIELD OF INVENTION

The present invention relates to apparatus and methods of assembly of balusters to balustrades or other horizontal rail members.

BACKGROUND OF THE INVENTION

Railing baluster connection devices have evolved over the last eighty years into two general categories. The first category could be referred to as single insert baluster connectors plugs. The first of this kind is exemplified in the device taught by Roth in U.S. Pat. No. 1,722,150. Roth teaches how to use a spherical connector plug that fits inside a hollow circular baluster. It hides the connection means from view and allows for the baluster to be pivoted to adapt to various stair angles if needed.

This concept was advanced by Harder in U.S. Pat. No. 7,441,750. Harder teaches the use of horizontal ribbing along the exterior of the spherical connector plug or "ball knob" as he refers to it. This provides a tighter frictional fit, allowing for use with circular and square hollow balusters and permits balusters whose ends are cut at the requisite angle to be pivoted and used in stair rail applications.

In U.S. Pat. No. 7,044,448, Jones teaches how to also use internal plugs but of a vertically cylindrical formation with a plurality of circumferentially located and longitudinally aligned tabs to provide some frictional engagement with the inner walls of the hollow balusters. This alone is not unique, however Jones further teaches the use of aluminum balusters and an inert plastic connector and stainless screws along with ACQ treated lumber to assemble the railing. This specific combination of elements prevents corrosion of aluminum balusters and fasteners and is the essence of Jones claims.

These plug style devices provide marginal frictional holding power between the connectors and the balusters and can easily separate, necessitating painstaking and pedantic realignment and re-insertion of balusters into their connectors, most often with the assistance of a second helper.

The most inconvenient aspect of all plug style devices in this class is that balusters must be assembled in the following manner: lower rail with baluster plugs is secured between posts, hollow balusters are fitted over baluster plugs in any order, upper rail with baluster plugs is carefully placed above remote ends of balusters and each baluster plug is precisely fitted one by one into each sequential baluster starting with the first baluster and working towards the last baluster. After the first three or four upper baluster plugs are fitted into their respective balusters, it becomes more difficult to keep the first plug(s) within their balusters as one moves systematically along the array of remaining upper baluster plugs trying to insert them into their respective balusters. The upper rail is then permanently affixed to opposing posts typically by toe-nail screwing or by post connectors thus completing the installation.

An in situ installation as described avoids the additional challenges associated with ex situ installations where the baluster assembly is built horizontally on a flat deck surface or work bench and then held tightly together by the installer to keep the rather loose collection of 2×4 rails and balusters from separating while simultaneously fitting the completed assembly between posts and securing it in place.

Railings between 48" and 72" long require a minimum of ten to fifteen balusters to comply with residential building codes. Therefore, systems using these kinds of baluster connectors commonly require two people for efficient installations to ensure that already fitted plugs and balusters do not accidentally separate as the other installer tries to downwardly force the plugs into the balusters at the opposite length of the rail. This is a pedantic but required exercise for this first category of single insert baluster plug connectors.

Among the prior art, there has emerged a second category of baluster connectors over the past twenty years which can best be described as two-part connection systems which offer differing functional and aesthetic benefits. The first device of note is that taught by Mohr in U.S. Pat. No. 6,126,145 which incorporated baluster inserts with remote ends threaded in opposite direction from each other so that by turning a baluster in one direction, both remote ends of the threaded connectors can thread into holes in opposing horizontal rails and pull the rails tight against the baluster ends. This ensures a very tight and secure fit, eliminating any loose fitting balusters. But it creates its own deficiencies and challenges because the railings are not easy to build in situ between railing posts with rails already attached to posts because they must be free to move vertically as they are turned tighter against the balusters.

In U.S. Pat. No. 8,424,850, Bennette teaches using a device that allows for a pendulum motion of installation. The Bennette device was created to work well with a proprietary decorative baluster lighting system and incorporates a unique wiring and fixture system in the non-moveable upper baluster connector. One of the purposes for this device is to allow a user to install or remove balusters after the railing has already been assembled. This is done by employing a device and method whereby the baluster can be released and swung in or out of the lower baluster connectors in a pendulum motion. It uses two asymmetrical baluster connectors, an upper and a lower connector, each comprised of two or more mating parts. The upper connector has a base part screwed to the underside of the upper horizontal rail over which a second internal fixture with an integral channel to cradle an electrical cord and two vertically oriented conductive metallic piercing prongs. The prongs can pierce the individual wires to create an electrical circuit. A third part; a circumferential threaded sleeve, is positioned around the upper baluster with the second fixture sandwiched between it and the first base part. The piercing prongs of the second internal fixture can be gradually forced into the electrical cords as the sleeve is turned onto the threads of the first base part thus completing the electrical circuit for the lighting system. The lower portion of the second internal fixture forms a male protrusion which the upper end of a baluster can fit around and then the lower remote end of the same baluster is swung inward toward a "C" shaped lower receptacle connector, itself screwed to the lower rail. Once the lower remote end of the baluster is fitted into the "C" shaped connector, a circumferential sleeve is slid down around the baluster and the "C" connector. However rather than a threading means to secure the sleeve against the "C" connector, a rotational locking mechanism is employed. Removing a baluster is the reverse of the process described. Alternately additional balusters can be added to the finished railing without having to remove the upper rail from the opposing posts. These are the primary benefits and attributes of the Bennette device.

In U.S. Pat. No. 7,971,412, Lim teaches the use of a two-part baluster connector system with baluster extensions allowing the baluster length to be adjusted to simplify installation and removal. Lim also uses a shoe cover which is slid down along the baluster to cover the interior and second part of the connector supporting the baluster. The cover is held in place by set screws and locking pins and does not frictionally engage and lock with its counterpart by way of a taper, unlike the proposed device that is the focus of this patent application and will be described further on.

A similar style device is taught by Truckner in U.S. Pat. No. 8,356,803 B2. Truckner teaches the use of a two-part adjustable baluster connector which employs a ball and socket joint and a sliding shoe cover which is locked in place by horizontal set screws or in a variation by screwing the shoe to its mating counterpart. The sliding cover does not rely on a friction fit or taper system to lock the parts and or squeeze the connector tightly against the baluster. It installs using a pendulum motion like the Bennette device. Its primary benefit is to take advantage of the ball joint to quickly adjust balusters for stair rail applications.

Yet another similar style device is explained by Sneith in U.S. Pat. No. 8,936,233. Sneith teaches the use of a lateral baluster installation method for attaching both top and bottom ends of a baluster into a three sided receiving connector. The entire device uses two mating three sided receiving connectors which lock together once the baluster is seated between them. A decorative shoe cover is then slid along the baluster and covers the receiving connectors. The cover is held in place by horizontal set screws.

The devices referenced in this second category of baluster connectors attempt to simplify installing or removing a baluster, work better with wiring systems required for baluster lighting applications and adjust easier to varying stair rail angles. They all do so to one degree or another. In addition, they avoid the inconvenience of simultaneously having to precisely align multiple hollow balusters with mating baluster connectors attached to a horizontal rail which is the common trait among the first category of described single insert baluster plug connectors.

After a thorough review of the prior art baluster connector solutions developed to date, one can see that while each device and method is designed to solve a specific problem, it leaves other problems in need of solutions.

Single insert baluster plug connectors, in all their variants, still require pedantic and patient aligning of multiple balusters simultaneously with their coincident upper rail connectors and this usually means working with a partner to maintain efficiency.

The two-part connector systems allow for installing and removing balusters without having to deconstruct the railing members from posts. They also can address varying angles for stair rail applications effectively and the covers can be shaped to mimic more ornate and classic architectural styles. However, some of these solutions have more than two unique parts as noted with the Sneith device, which increases material costs and time to install.

The covers are held in final position by using screws and locking pins which are finicky and take more time to install. Nor do the connectors function in such a way as to constrict around a baluster in order to hold it tightly in place between upper and lower rails and resist vertical tension forces that would separate them. Therefore these systems are intended to be most easily installed during in situ applications. While there have been a number of solutions brought to market over the last ten years, none address and solve the main user demand of employing an easier or faster means of installation that can be installed by one person in situ or ex situ applications in an elegant manner. Nor do the prior art examples offer a simpler means of maintaining the railing system by either simplifying removal of balusters if required or quickly popping up the exterior male covering connector so re-staining or painting of the 2×4 can be done quickly without having to be carefully and slowly painting around each baluster.

To avoid the annoyances of installing single insert baluster plug connectors, such two-part connector systems were developed. They also made it possible to improve or elevate the appearance of the finished system. However, they necessarily use more material and in fact the Sneith device uses three parts. Given that the single insert plug connectors use the least material and have been on the market the longest they are sold at the most competitive price level and this has become the established baseline in the minds of consumers. Two-part (or even three part) solutions use more material and cost more to manufacture placing them at a disadvantage. They can be designed however to look more ornate and this can be a differentiating factor which can justify a higher selling price to some degree. However, if the two-part system is more finicky to install, which is the case when set screws and locking pins are employed, any compelling aesthetic quality it possesses that serves to justify a higher selling price may be offset by the more complicated way it assembles. The baluster system of the present invention device addresses these problems.

SUMMARY OF THE INVENTION

The apparatus and method of the present invention provides a principle benefit of a unique, simpler and faster way in which the balusters can be fitted and secured between horizontal or sloped rails during the initial different phases of assembly without having to simultaneously and precisely align a plurality of balusters with receptacles or receiving connectors nor having to affix mating connectors by threading or rotational means. The present invention also provides the benefit of easily adding, removing or repositioning balusters within a completed balustrade without having to detach the upper and lower horizontal rails from adjacent posts. This assembly of balusters between rails can be achieved by a purely horizontal, or lateral motion of the baluster and perpendicular to the imaginary vertical plane between the upper and lower horizontal rails whereby the baluster fits into the receiving connectors such that upper and lower horizontal rails can already be affixed at their final elevations relative to one another so that no extra distance or height apart from each horizontal rail is needed, in contrast to slightly extra height differential that would be required to allow for a pendulum style motion of locating one end of a baluster into one connector, either upper or lower, and then rotating the other end of the baluster along an arc into the remaining connector and then lowering the upper and lower horizontal rails closer together to eliminate the gap in height between baluster ends and connectors. This eliminates up and down movement and potential rattling. This is a common annoyance and shortcoming of many prior art connection systems. Furthermore, the present assembly system and device employs a two-part mating connector comprising of a connector base or shoe and a vertically sliding connector cover that frictionally engage each other by virtue of a taper in mating surfaces, thereby urging the connector against baluster. The connector base and cover also firmly snap and lock together so that the frictional force against the balusters is maintained while being handled and cannot easily be released by any tensional forces. This prevents the plurality of balusters from separating from the upper or lower horizontal rails. This in turn provides a number of immediate benefits to the user that differentiate it from the prior art.

One of the most annoying aspects of installing hollow metal balusters over plastic prior art inserts that are connected to upper and lower rails is the precision required to simultaneously align all ten or fifteen balusters with the final course of inserts. This procedure most often—at least for the do it yourselfer—requires two pairs of hands to avert problems. Installing the balusters to the first course of connectors is easy and quick given the remote ends of each baluster can stand freely. The problem arises the minute one takes the last rail (usually the upper 2×4 rail) and begins to place the plastic inserts (plug style) into the first, second then third baluster. The first two balusters can be fitted over the inserts quickly. But the third baluster requires lifting the second insert up and out of the second baluster a little bit while still ensuring the first insert is still set deep enough into the first baluster so that it does not pull out. This process becomes more difficult by the fourth baluster and even more so by the fifth baluster.

With each sequential baluster to insert, the difficulty of keeping all prior baluster connectors still set and secured in their respective balusters increases. By the time a user has reached the sixth or seventh baluster a second pair of hands (of an assistant) is required to steady the upper rail at just the perfect elevation so that the new baluster to install can clear the next insert and be aligned precisely for insertion, all the while not pulling out the penultimate insert from its coincident baluster. One must also be mindful of all the previous balusters whose inserts are partially pulled out and are precariously resting on the last part of the inner circumferential edge of each baluster in order to accommodate each new baluster insertion. In practical terms, it is virtually impossible to get to the final baluster without accidentally pulling out one or more or all of the other balusters. This is where the assistant is required to ward off the impending disaster. This process, which is very pedantic and inconvenient, is common to most of the prior art devices. The present invention eliminates this problem entirely and permits quick and easy installations by one person.

The present invention allows for varying installation or assembly methods; either building the rail between railing posts in situ by first installing a lower horizontal rail, baluster connectors, balusters, then upper horizontal rail at exact height in precise tolerance to upper remote end of balusters and locking covers over the base to complete as previously described or ex situ, by assembling the rail and balusters on a bench or other horizontal flat surface whereby the ends of each horizontal 2×4 rail are later affixed to opposing railing posts using connectors available on the market. This latter bench style installation is very conducive to the sliding and locking aspect of the device. Once the connector covers are lowered and frictionally engaged against the connector bases, the cover clicks and mechanically locks the parts into their final home position confirming a perfection installation. The entire rail assembly can be lifted up without any significant risk of the balusters disengaging and the assembly falling apart. The rail assembly can then be moved from the bench and mounted between opposing posts. Almost all the prior art devices, are best installed in situ because of their looser final fit. Even those connectors which employ ridges or splines to accommodate smaller variances in baluster dimensions and to provide some frictional engagement with the balusters are not conducive to ex situ installations unless the entire rail assembly is carefully held together to prevent it from falling apart. The connectors of the present invention actually grip the balusters tightly creating a more strongly connected assembly giving the user more choice of installation options.

As a result of the firmer and stronger final connection between baluster and connector, the present invention more effectively prevents rattling of the balusters within a certain range of baluster cross sectional dimensions making it applicable to more than one manufacturer's balusters.

Another benefit is the ease of removal of one or more balusters from the balustrade should such be necessary, or the ease of raising the decorative connector cover to permit easy re-staining of a rail or surface without having to painstakingly avoid over spray on the decorative cover connectors. The foregoing is easily done by inserting the thin tip of a slot screw driver tip under a recess line along the lower peripheral edge of the connector cover and levering it upward to unsnap the parts and break the friction hold of the taper fit allowing the cover to be elevated. The rail can be quickly re-stained and even if the inner connector is accidentally painted, the cover will hide it when it is lowered down again. Or the baluster can be easily pulled horizontally from the lower and upper connectors bases for replacement while the balustrade remains intact. Very few of the prior art devices allow for this, and those that do have other disadvantages as explained above.

The present invention addresses competing needs of appearance, performance and cost of materials, simplified installation and removal of balusters once the railing members are installed while functioning easier and more elegantly than the prior art. The present invention provides speed of installation and removal and is suitable for in situ and ex situ installations techniques for greater convenience and minimal use of parts.

The present invention provides a baluster apparatus and method of fastening and connecting of balusters to balustrades or railings in a manner whereby the baluster is installed using a lateral motion relative to the connectors that are secured to a horizontal rail, said connectors comprising a connector base and a connector cover. Once the baluster is fitted into the connector base it is followed by sliding the connector cover down the baluster and constricting around the baluster by means of a taper fit interaction between the two connector parts. The friction fit taper lock feature of the two-part connectors further contrasts with the locking features of other two-part baluster connectors which lock together by way of common set screws or threaded means between parts and are thereby slower to use or lack the constricting feature of the present invention as elaborated below.

The baluster connection system provides a connection which constricts and firmly grips each baluster, so the rail and baluster section is rigid enough that it can be lifted and moved from a bench to an awaiting plurality of newel posts for attachment. The baluster system can be installed in situ quickly and easily between two existing top and bottom rail balustrades of a railing. This eliminates the need to remove the top rail for the remote terminal ends of the balusters to be fitted with the top rail connectors. It also lends itself to quickly and easily retro-fitting an old wood railing with wood spindles that are affixed to the sides of the 2×4 balustrades. The spindles are unscrewed, and the new baluster system can be attached to the narrow horizontal planar surface of the 2×4 balustrades.

The baluster system permits easy removal of the balusters for re-staining of a weathered railing. This is done by popping the connector cover vertically away from the connector base and laterally removing the baluster out of the connector base. Stain can then be quickly applied in a more carefree manner where accidentally applying paint to the base is less problematic because it will be conveniently hidden by the cover when the baluster is re-seated. The baluster and cover remain stain free.

The constriction feature is the result of precisely designed opposing vertical tapered surfaces between the connector base and the connector cover. The more that the cover is pushed down, the more the connector constricts around the baluster. A user knows when the base and cover have been fully seated together by a series of small tabs and channels that snap together.

The baluster system further provides a wedge like adapter that can fit into the bottom area of the shoe to allow for sloped balustrades such as stair rail applications based on the most common rise and run slope used in residential construction.

Accordingly, in one aspect, the present invention provides a baluster apparatus for removably locking a baluster in a balustrade, the balustrade having upper and lower surfaces that are oppositely disposed a distance apart, the baluster apparatus comprising: a pair of connector bases, each connector base comprising a base member having a bottom surface suitable for mounting to one of the upper and lower surfaces, a top surface opposite the bottom surface; a wall extending in a perpendicular orientation from the top surface and defining an inner wall surface, and an outer wall surface that tapers inwardly from the top surface; a baluster having baluster ends and being removably lockable between the pair of connector bases, wherein the wall of each connector base is configured to laterally receive a baluster end for a close fit between the baluster end and the inner wall surface of the wall, and wherein the baluster is insertable into and removable from the connector bases without removing the connector bases from the one of the upper or lower surfaces or without moving the upper or lower surfaces apart; and a pair of connector covers each being slidable along a portion of the baluster, each connector cover comprising a tubular member having an upper portion defining a first opening configured to fit around the baluster, a lower portion defining a second opening configured to closely fit around the base member, and an internal wall configured to closely abut the outer wall surface of the wall and having a complementary taper to the outer wall surface so as to urge the wall toward the end of the baluster to provide frictional engagement between the inner wall surface and the end of the baluster when the second opening is slid onto the base member.

In some embodiments, the wall may extend more than half way around a periphery of the baluster end.

In some embodiments, the wall may define wall ends that may be a distance apart that is less than a cross-sectional width of the baluster end such that the wall ends releasably capture the baluster end as it is slid laterally between the wall ends into a space defined by the wall.

In some embodiments, the apparatus may further comprise a first locking member defined on an edge of the base member, and a second locking member defined on the second opening and configured to engage the first locking member as the second opening is slid around the base member to releasably lock the connector cover to the connector base.

In some embodiments, the first locking member may be a channel defined on an edge of the base member, and the second locking member may be an inward projection on the second opening configured to engage the channel.

In some embodiments, the apparatus may further comprise a void defined in the top surface of the base member adjacent each wall end such that the wall ends may flex to facilitate the lateral insertion or withdrawal of the baluster end into or from the space defined by the wall.

In some embodiments, the wall may be generally C-shaped and the baluster ends may be round in cross-sectional shape.

In some embodiments, the apparatus may further include an aperture disposed within the base member for receiving a fastener for attaching the connecter base to one of the upper or lower surfaces of the balustrade.

In some embodiments, apparatus may further comprise an angle adaptor having a second top surface suitable for receiving the connector base and an angled second bottom surface configured to mount onto one or both of upper or lower surface of the balustrade in a manner to vertically orient the baluster within the balustrade.

In some embodiments, the apparatus may further comprise a second void in the bottom surface of the connector base and a projection on the second top surface that is complementary to the second void to provide a locking fit between the connector base and the angle adaptor.

BRIEF DESCRIPTION OF DRAWINGS

For a better understanding of the present invention and to show more clearly how it may be carried into effect, reference is made by way of example to the accompanying drawings in which.

DETAILED DESCRIPTION

Figure 1:
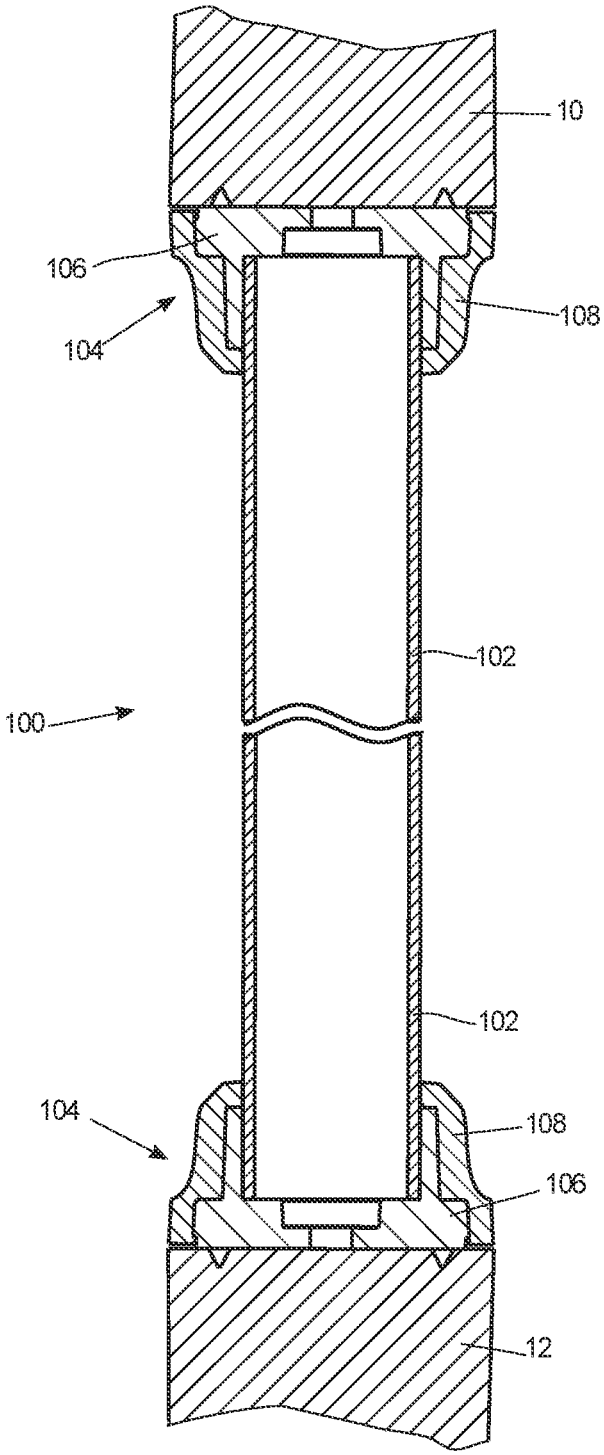
FIG. 1 is a longitudinal section of a baluster apparatus in accordance with an embodiment of the present invention.
Figure 2:
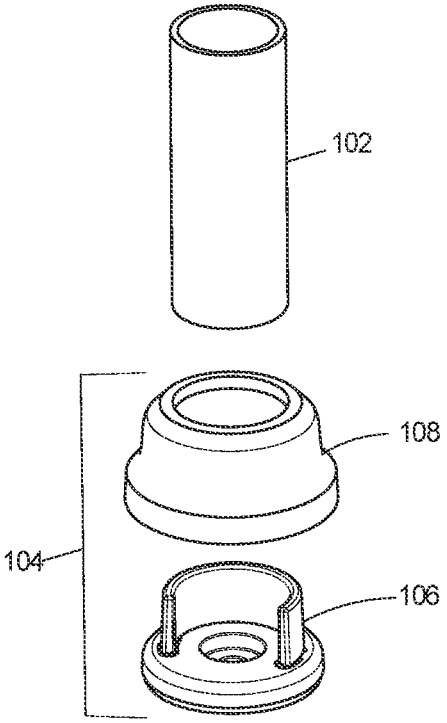
FIG. 2 is an exploded perspective view of the baluster apparatus of FIG. 1.
Figure 3:
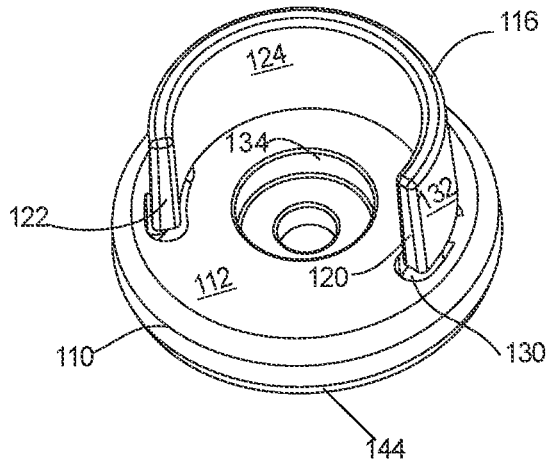
FIG. 3 is a top perspective view of the connector base of the embodiment of FIG. 1.
Figure 4:
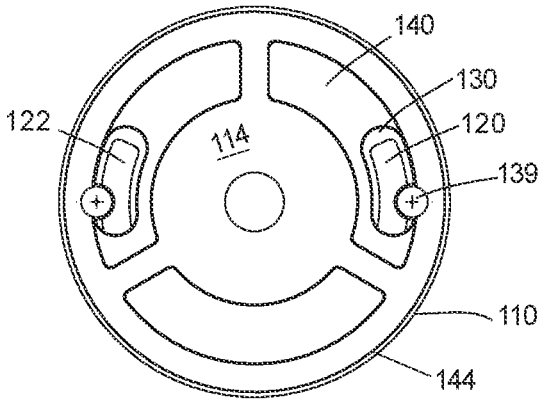
FIG. 4 is a bottom plan view of the connector base of FIG. 3.
Figure 5:
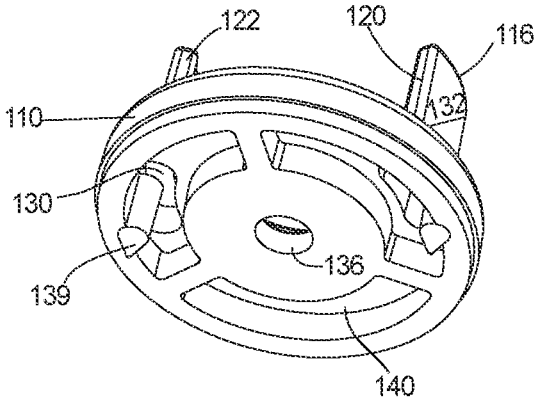
FIG. 5 is a bottom perspective view of the connector base of FIG. 3.
Figure 6:
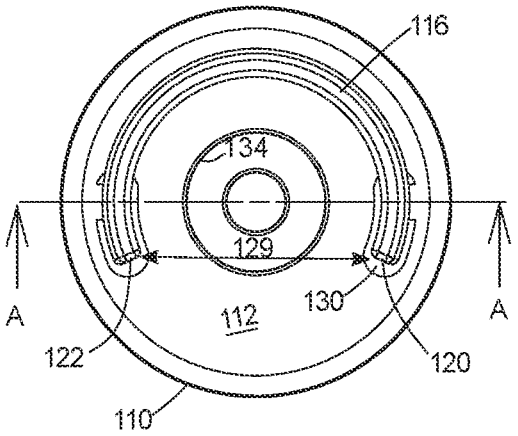
FIG. 6 is a top plan view of the connector base of FIG. 3.
Figure 7:
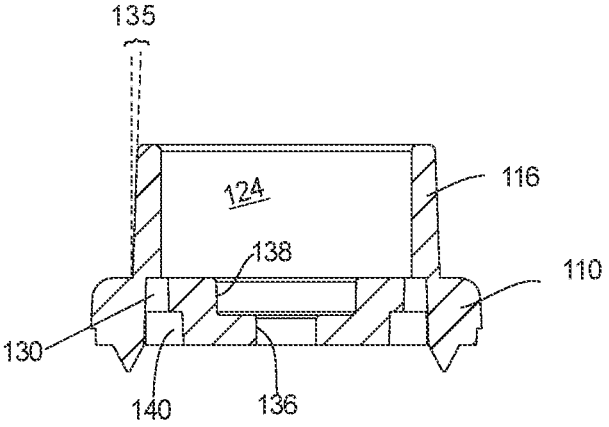
FIG. 7 as a cross section view of the connector base of FIG. 6 along line A-A.
Figure 8:
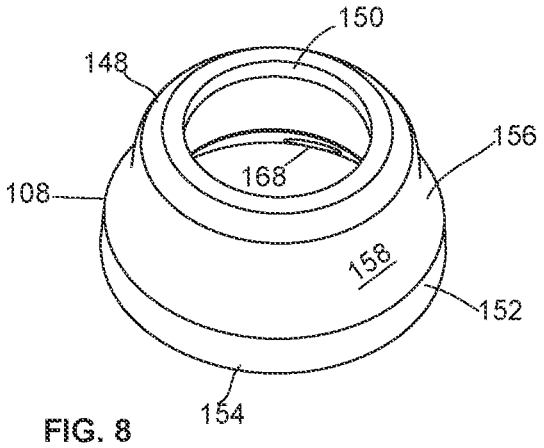
FIG. 8 is a top perspective view of the connector cover of the embodiment shown in FIG. 1.
Figure 9:
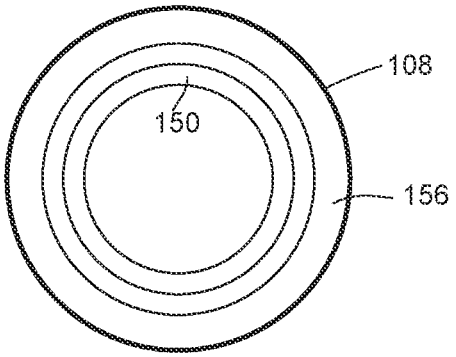
FIG. 9 is a top plan view of the connector cover of FIG. 8.
Figure 10:
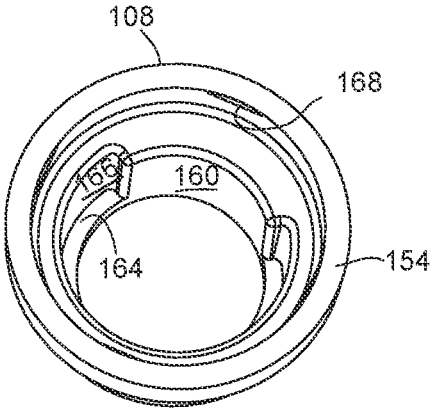
FIG. 10 is a bottom perspective view of the connector cover of FIG. 8.
Figure 11:
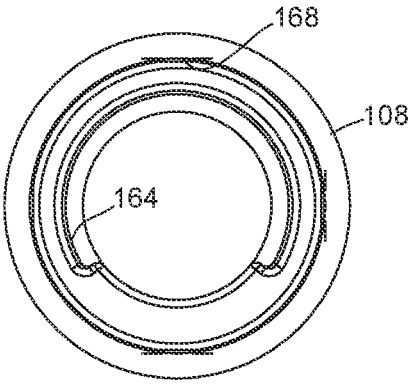
FIG. 11 is a bottom plan view of the connector cover of FIG. 8.

For the purposes of promoting an understanding of the principles of the invention reference will now be made to the exemplary embodiment illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one, skilled in the relevant art and having possession of this disclosure, are to be considered within the scope of the invention.

Referring to FIGS. 1-12, there is depicted an embodiment of a baluster apparatus 100 in accordance with an embodiment of the present invention. The baluster apparatus 100 comprises a baluster, such as hollow cylindrical baluster tube 102, sized for mounting between an upper railing 10 and a lower railing or railing base 12, and a pair of baluster connectors 104 that connect the baluster tube to the railings. The upper railing 10 and the lower railing or base 12 define the upper or lower surfaces of a balustrade. In some embodiments, the baluster may be a solid component rather than tubular.

References made herein with respect to spatial orientations or directions, such as up, down, vertical, etc., pertain to the orientation with respect to the referenced components as illustrated, but does not necessarily reflect the orientation of the components as they may be operationally mounted in a railing system.

Each baluster connector 104 comprises a connector base 106 for mounting on the railing or the railing base and a connector cover 108 that slides on the baluster tube 102 to mate with and cover the connector base 106.

The connector base 106 comprises a planar base member, such as disk member 110, having a top surface 112 and a bottom surface 114. A wall, such as partial peripheral wall 116, extends in a vertical orientation from the top surface 112. The partial peripheral wall 116 defines an arc wall portion that can be described as being "C" shaped and having wall ends or end portions 120 and 122. The wall 116 defines inner wall surface 124 that is vertically oriented and configured to closely receive therein an end of the baluster 102 such that the inner wall surface 124 abuts the outer surface of the end of the baluster 102 as the wall 116 wraps around a portion of the end of the baluster. Preferably the wall extends more than half way around the periphery of the baluster end. Preferably, the wall ends are a distance apart that is less than a cross-sectional width of the baluster end such that the wall ends releasably capture the baluster end as it is slid laterally between the wall ends into a space defined by the wall. Hence the distance 129 between the ends 120 and 122 of the peripheral wall 116 is slightly less than the outer wall cross-sectional diameter of the end of the baluster tube 102 and is configured to receive said end by a snap fit as the baluster tube end is laterally pressed into the opening defined by the ends 120 and 122 of the wall 116 until the baluster tube end is received within the space defined by the wall 116. Preferably, the baluster tube 102, the wall 116, or both are made of material that is resiliently deformable, such as for example plastic, that enables one or both to be slightly deformed as the baluster and is pressed laterally into the void of the wall 116 between ends 120 and 122. In order to aid the deformation of the wall 116, a void 130 may be provided in the material of the disk member 110 adjacent each end 120 and 122 such that outward deflection of the ends is facilitated as a result of the ends not being connected to the disk member 110.

The wall 116 defines an outer wall surface 132 that is tapered inwardly from the vertical 131 from the top surface 112 (best shown in FIGS. 7 and 12) such that the outer diameter of the wall 116 adjacent the top surface 112 is wider than the outer diameter of the wall that is remote from the top surface. Preferably, the outer wall surface 132 is sloped at an angle 135 that is between about 2° to about 4° from vertical, and preferably by about 2.5°.

The connector base 106 is mountable to a surface by means of a countersunk mounting hole 134 located centrally on the disk member 110 and comprising a narrow portion 136 for receiving the shaft of the screw and a wide portion 138 that accommodates the head of the screw such that screw head sits below the top surface 112.

The bottom surface 114 of the disk member 110 may be completely flat or it may be provided with projections 139 that are configured to bite into the material of the railing 10 or railing base 12 so as to prevent the connector base from moving or rotating out of position. As well, the bottom surface 114 may be provided with a plurality of voids 140 which may be a material saving measure or which may also be used in helping to locate the connector base 106 with respect to an angle adapter 170 as will be described below.

The bottom peripheral edge of the disk member 110 defines a first locking member such as channel 144 that is engaged by a complementary second locking member on the connector cover 108 in order to provide an interference snapfit engagement between the connector cover 108 and connector base 106.

The connector cover 108 comprises generally of a tubular member having an upper portion 148 that defines a circular opening 150 adapted to closely fit around the outer surface of the baluster tube 102, and a lower portion 152 defining an opening 154 that is adapted to closely fit around outer circumference of the disk member 110 on the connector base 106. On the inside surface of the lower opening 154 is provided with the second locking member such as an inwardly projecting flange or (as illustrated) inwardly projecting tabs 168 that are adapted to engage the channel 144 of the connector base to provide snapfit engagement between the connector cover 108 and the connector base 106.

Figure 12:
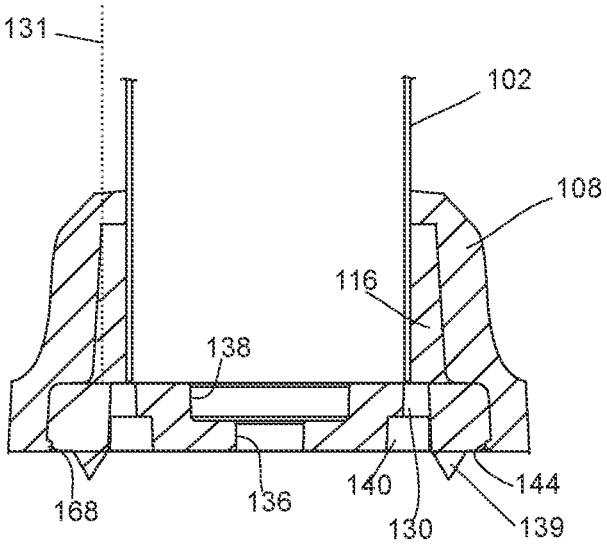
FIG. 12 is a close up cross section view of one end of the baluster apparatus of FIG. 1 showing the baluster, the connector base and the connector cover.

In the illustrated embodiment, the cylindrical wall portion 156 of the connector cover tapers inward from the opening 154 toward the opening 150 and may have an outer surface 158 shaped to provide an aesthetic appearance. The inner surface 160 of the wall portion 156 defines a channel 164 that is complementary in shape and dimension to the wall 116 of the connector base 106 in a manner that the wall 116 is closely received within the channel 164 when the connector cover 108 is fully engaged with the connector base 106. The internal surface 166 of the channel 164 is also tapered by an angle from the vertical so as to be complementary to the angle of the outer surface 132 of the partial circumferential wall 116 (as best shown in FIG. 12). Accordingly, the mating tapered surfaces create an engagement there-between as the connector cover 108 is slid upon the connector base 106, which forces the inner surface 124 of the wall 116 against the outer surface of the end of the baluster tube 102. This engagement between the mating tapered surfaces also provides a frictional engagement that aids in maintaining the connector cover 108 in place when fully seated upon the connector base 106 with the baluster tube 102 in place.

In the use of the baluster system 100, two connector bases 106 are used in which one connector base 106 is mounted to the under surface of upper railing 10 and another connector base 106 is mounted inner vertical alignment on an upper surface of the lower railing or railing base 12 at a location at which the baluster tube 102 is intended to be mounted. The connector bases 106 are preferably mounted such that the openings defined by the wall 116 generally face the same direction. A connector cover 108 is slid onto each end of the baluster tube 102 such that the opening 154 of each connector cover 108 faces the adjacent end of the baluster tube 102. The baluster tube 102 is then aligned with the connector bases such that each end of the baluster tube abuts an opening of the adjacent connector base. The ends of the baluster tube are then pressed into the partial peripheral wall of each connector base. Once the ends of the baluster tubes are received within the space defined by the wall 116 of the connector bases 106, the connector cover 108 adjacent each end is slid over its adjacent connector base 106 and is pressed firmly onto said connector base until the inward flange or tabs 168 at the opening 154 are pressed inward into an interference engagement with the channel 144 of the connector base 106 to provide a locking engagement between the connector cover and connector base (as shown in FIG. 12). As a result of the complementarily tapered outer surface 132 of the wall 116 and the inside surface 166 of the channel 164 the connector cover, the two surfaces abut each other and the inside surface 166 acts upon the outside surface 132 as the connector cover is pressed onto the connector base which urges the wall 116 inward such that the inside surface 124 squeezes against the outside surface of the baluster to 102 so as to secure the baluster tube into the baluster connector 104.

Removal of the baluster tube from the railing may be accomplished by using a screwdriver or other sharp object to dislodge the connector cover 108 from the connector base 106 and then by withdrawing each end of the baluster tube 102 from its adjacent base connector 106.

Figure 13:
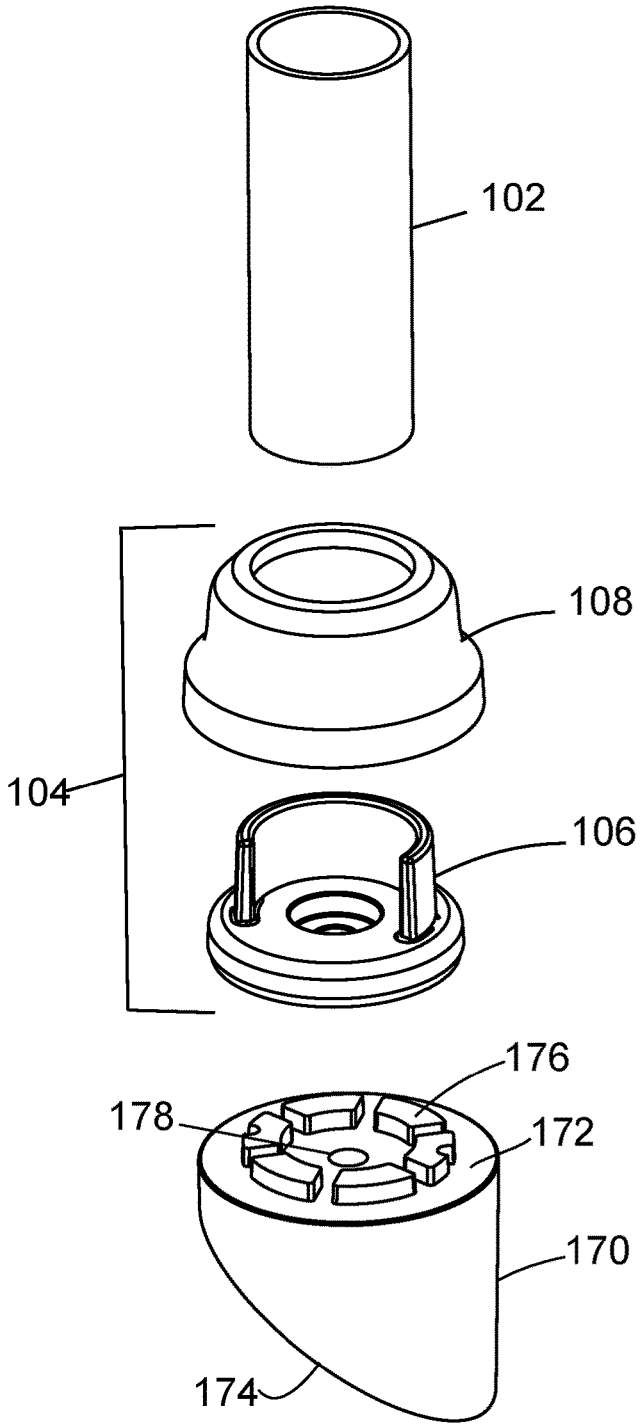
FIG. 13 is an exploded perspective view of the baluster apparatus of FIG. 1 with an angle connector adapter.
Figure 14:
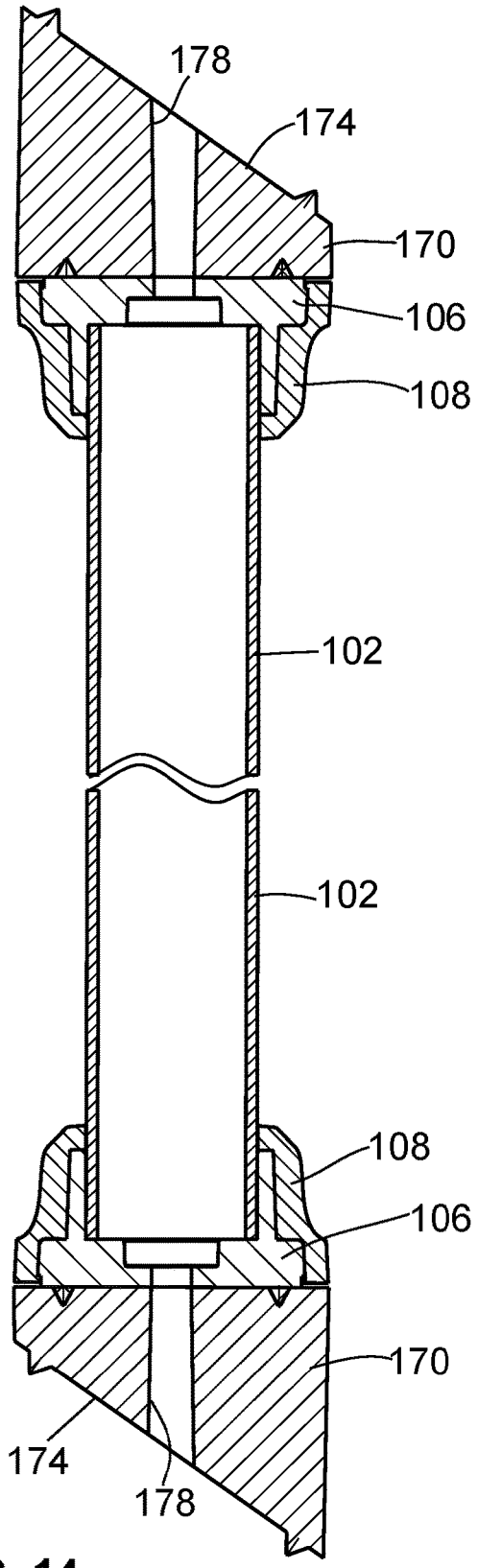
FIG. 14 is a longitudinal section of the baluster apparatus of FIG. 13.
Figure 15:
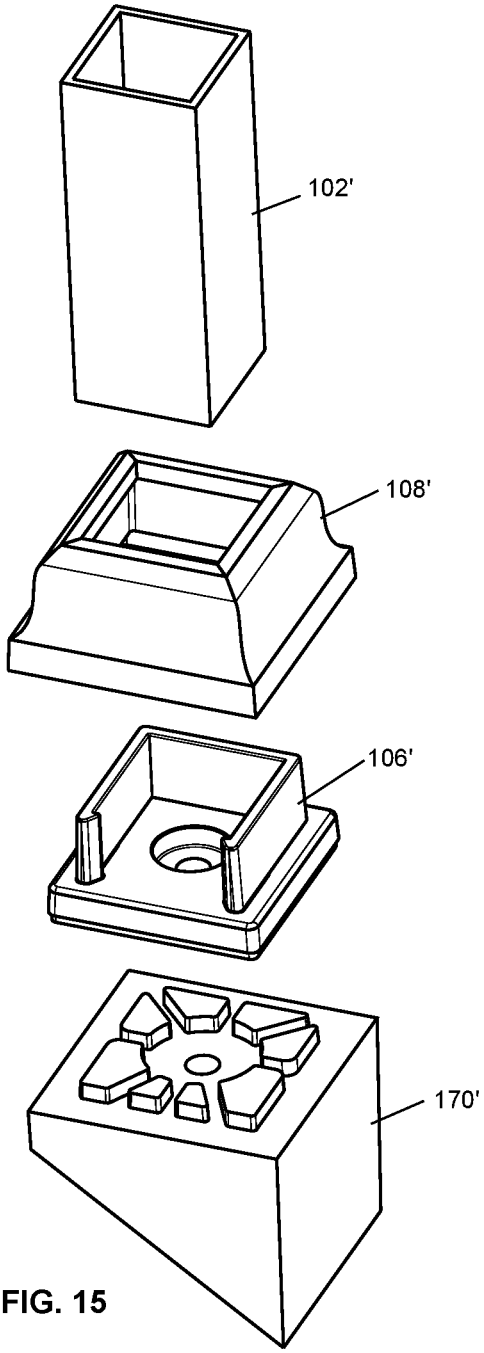
FIG. 15 is an exploded perspective view of a variant of the baluster apparatus in accordance of the present invention.
Figure 16:
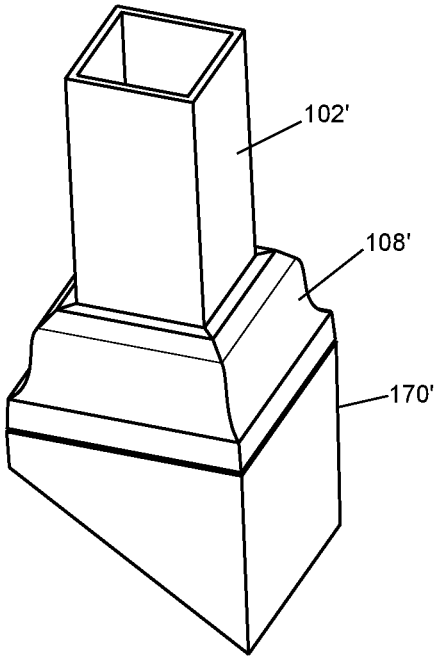
FIG. 16 is a perspective view of the assembled baluster apparatus of FIG. 15.

Referring to FIGS. 13 and 14, in order to accommodate sloped railings, such as on staircases and the like, the baluster system 100 may further comprise angle connector adapters 170 that have a horizontally oriented surface 172 and a sloped surface 174 that is at a complementary angle to the surface of the railing or railing base such that when the connector adapter 170 is mounted on said railing or railing base, the surface 170 is maintained generally horizontal, and thereby the connector base 106 may be mounted to the horizontal surface 172 of the connector adapter 170, which results in a vertical orientation of the baluster tube 102.

In some embodiments, the bottom surface 114 of the connector base 106 may be provided with the voids 140, and the surface 172 of the connector adapter 170 may be provided with protrusions 176 that are shaped and configured to fit within the voids 140 of the connector base. Thereby, the connector base 106 may be positioned and located onto the surface 172 as the protrusions 176 mate within the voids 140. However, in some embodiments the bottom surface 114 of the connector base and the surface 172 of the connector adapter 170 may simply be flat.

Or the bottom surface 114 may be provided with the projections 139 as previously described which can be pressed into the material of the connector adapter 170 in order to prevent the connector base 106 from rotating with respect to the connector adapter 170.

Figure 17:
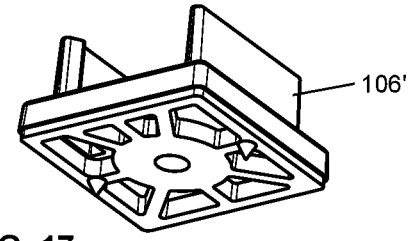
FIG. 17 is a bottom perspective view of the connector base of FIG. 15.
Figure 18:
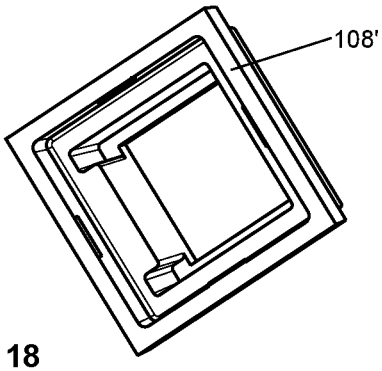
FIG. 18 is a bottom perspective view of the connector cover of FIG. 15.

Referring to FIGS. 17 and 18, there is shown an embodiment of the baluster apparatus of the present invention in which the baluster tube 102' is square in cross-section and the connector base 106' and connector cover 108', and the optional connector adapter 170', are configured to be square. In other aspects, the features of the square configuration work on the same principles as with the round configuration.

Figure 20:
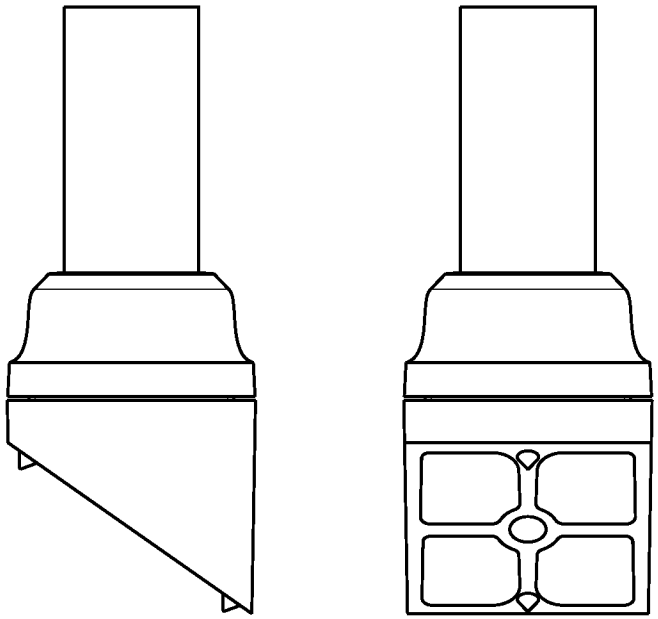
FIG. 20 shows an example of the baluster apparatus of FIG. 15 from the side and back.
Figure 19:
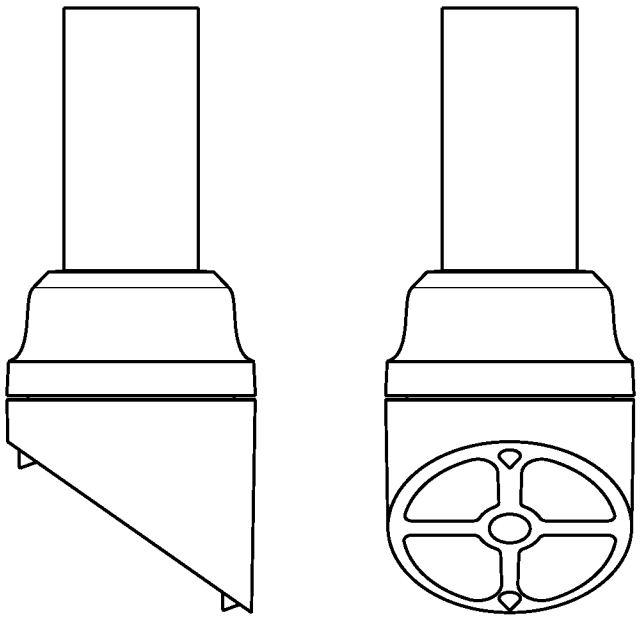
FIG. 19 shows an example of the baluster apparatus of FIG. 13 from the side and back.

Referring to FIGS. 19 and 20, there are shown some variants of the round and square baluster systems.

While the above description and illustrations constitute preferred or alternate embodiments of the present invention, it will be appreciated that numerous variations may be made, such as altering the perimeter shape, without departing from the scope of the invention. It is intended that the invention be construed as including all such modifications and alterations.

The invention claimed is:

1. A baluster apparatus for removably locking a baluster in a balustrade, the balustrade having upper and lower surfaces that are oppositely disposed a distance apart, the apparatus comprising:

a pair of connector bases, each connector base comprising a planar base member having a bottom surface suitable for mounting to one of the upper and lower surfaces, a top surface opposite the bottom surface;

a wall extending in a perpendicular orientation from the top surface and defining an inner wall surface and an outer wall surface that tapers inwardly from the top surface;

a baluster having baluster ends and being removably lockable between the pair of connector bases, the wall of each connector base being configured to laterally receive a baluster end for a close fit between the baluster end and the inner wall surface of the wall, and the baluster being insertable into and removable from the connector bases without removing the connector bases from the one of the upper or lower surfaces or without moving the upper or lower surfaces apart;

the wall extending more than halfway around a periphery of the baluster end and defining wall ends that are a distance apart that is less than a cross-sectional width of the baluster end such that the wall ends releasably capture the baluster end as it is slid laterally between the wall ends into a space defined by the wall; and a pair of connector covers each being slidable along a portion of the baluster, each connector cover comprising a tubular member having an upper portion defining a first opening configured to fit around the baluster, a lower portion defining a second opening configured to closely fit around the base member, and an internal wall configured to closely abut the outer wall surface of the wall and having a complementary taper to the outer wall surface so as to urge the wall toward the end of the baluster to provide frictional engagement between the inner wall surface and the end of the baluster when the second opening is slid onto the base member.

2. The apparatus as claimed in claim 1 further comprising a first locking member defined on an edge of the base member, and a second locking member defined on the second opening and configured to engage the first locking member as the second opening is slid around the base member to releasably lock the connector cover to the connector base.

3. The apparatus as claimed in claim 2 wherein the first locking member is a channel defined on an edge of the base member, and the second locking member is an inward projection on the second opening configured to engage the channel.

4. The apparatus as claimed in any one of claims 1-2 wherein the outer wall surface is sloped at an angle between about 2° to about 4° from vertical.

5. The apparatus as claimed in any one of claims 1-2 wherein the outer wall surface is sloped at an angle of about 2.5° from vertical.

6. The apparatus as claimed in any one of claims 1-3 further comprising a void defined in the top surface of the base member adjacent each wall end such that the wall ends may flex to facilitate the lateral insertion or withdrawal of the baluster end into or from the space defined by the wall.

7. The apparatus as claimed in any one of claims 1-3 wherein the wall is generally C-shaped and the baluster ends are round in cross-sectional shape.

8. The apparatus as claimed in any one of claims 1-3, further including an aperture disposed within the base member for receiving a fastener for attaching the connecter base to one of the upper or lower surfaces of the balustrade.

9. The apparatus as claimed in any one of claims 1-3, further comprising an angle adaptor having a second top surface suitable for receiving the connector base and an angled second bottom surface configured to mount onto one or both of the upper and lower surfaces of the balustrade in a manner to vertically orient the baluster within the balustrade.

10. The apparatus as claimed in claim 9, further comprising a second void in the bottom surface of the connector base and a projection on the second top surface that is complementary to the second void to provide a locking fit between the connector base and the angle adaptor.

* * * * *